United States Patent [19]

Padarev

[11] Patent Number: 4,741,246

[45] Date of Patent: May 3, 1988

[54] STAGE SELECTABLE TELESCOPIC CYLINDER ASSEMBLY

[75] Inventor: Nikolay K. Padarev, Mayfield Heights, Ohio

[73] Assignee: Universal Hydraulics, Inc., Willoughby, Ohio

[21] Appl. No.: 894,110

[22] Filed: Aug. 7, 1986

[51] Int. Cl.[4] ..... F15B 11/18

[52] U.S. Cl. ..... 91/167 R; 91/167 A; 91/173; 91/530; 91/159; 92/53; 92/55

[58] Field of Search ..... 92/52, 53; 91/167 A, 91/167 R, 173, 530, 159

[56] References Cited

U.S. PATENT DOCUMENTS 3,603,207 9/1971 Parrett ..... 91/167

3,610,100 10/1971 Hoffman ..... 91/167

*Primary Examiner*—Robert E. Garrett

*Assistant Examiner*—Thomas E. Denion

*Attorney, Agent, or Firm*—Renner, Otto, Boisselle & Sklar

[57] ABSTRACT

A multiple stage telescoping cylinder assembly, which provides full stage selection capability without the need for external hoses or reels, comprises a base; an inner cylinder attached at its rearward end to the base and first and second stage cylinders of successively greater diameter mounted on the inner cylinder in telescoping relationship for extension during their forward strokes and retraction during their rearward strokes, the first and second stage cylinders each having an extend facing surface relatively adjacent its forward end for fluid pressure to contact to effect extension thereof and a retract facing surface relatively adjacent its rearward end for fluid pressure to contact to effect retraction thereof; and plural fluid passages for directing fluid under pressure from the rearward end of the inner cylinder forwardly through the interior of the inner cylinder and then into contact with respective ones of the facing surfaces for selective extension and retraction of the first and second stage cylinders independently of one another.

16 Claims, 3 Drawing Sheets

STAGE SELECTABLE TELESCOPIC CYLINDER ASSEMBLY

The invention herein described relates generally to fluid actuated telescopic cylinder assemblies and, more particularly, to a multiple stage telescopic cylinder assembly having full stage selection capability.

As utilized herein, full stage selection capability means the ability to extend or retract each stage of the telescopic cylinder assembly independently of the other stage or stages.

BACKGROUND

Telescopic cylinder assemblies have been employed as actuators in boom cranes, digger derricks, pole setters (stingers) and other extension/-retraction mechanisms. For some applications, it is desirable to use a multiple stage telescopic cylinder assembly having full stage selection capability. To this end, some telescopic cylinder assemblies have included an inner cylinder mounted to a base and an intermediate cylinder and an outer cylinder of successively greater diameter mounted on the inner cylinder in telescopic relationship. Selective independent extension and retraction of the intermediate or first stage cylinder have been achieved by means of internal porting, but external hoses heretofore have been needed to accomplish selective independent extension and retraction of the outer or second stage cylinder. A problem with such assemblies is that the hoses can fail and lead to break-down. There also is a requirement for hose reels, external hose supports, guides, etc. to compensate for the extension and retraction of the assembly.

SUMMARY OF THE INVENTION

A multiple stage telescopic cylinder assembly according to the present invention achieves full stage selection capability without the need for external hoses and reels. By eliminating the external hoses and reels, the assembly is less expensive and more reliable and compact.

Briefly summarized, a multiple stage telescoping cylinder assembly according to the invention comprises: a base at a rearward end of the assembly; an inner cylinder attached at its rearward end to the base and first and second stage cylinders of successively greater diameter mounted on the inner cylinder in telescoping relationship for extension during their forward strokes and retraction during their rearward strokes, the first and second stage cylinders each having an extend facing surface relatively adjacent its forward end for fluid pressure to contact to effect extension thereof and a retract facing surface relatively adjacent its rearward end for fluid pressure to contact to effect retraction thereof; and plural fluid passage means for directing fluid under pressure from the rearward end of the inner cylinder forwardly through the interior of the inner cylinder and then into contact with respective ones of the facing surfaces for selective extension and retraction of the first and second stage cylinder independently of one another.

More particularly, a multi-stage telescoping cylinder assembly according to the invention comprises: a base at the rearward end of the assembly; an inner cylinder attached at its rearward end to the base and intermediate and outer cylinders of successively greater diameter mounted on the inner cylinder in coaxial telescoping relationship for extension during their forward strokes and retraction during their rearward strokes, the inner and intermediate cylinders respectively having outer and inner surfaces forming therebetween a first pressure space and said intermediate and outer cylinders respectively having outer and inner surfaces forming therebetween a second pressure space; an inner cylinder head at the forward end of the inner cylinder for slidably engaging the inner surface of the intermediate cylinder and sealing the forward end of the first pressure space; an intermediate cylinder rear head carried on the rearward end of the intermediate cylinder for slidably engaging the outer diameter surface of the inner cylinder and sealing the rearward end of the first pressure space, the intermediate cylinder rear head having a first facing surface for fluid pressure in the first pressure space to act to effect retraction of the intermediate cylinder; an outer cylinder rear head carried on the rearward end of the outer cylinder for slidably engaging the outer diameter surface of the intermediate cylinder and sealing the rearward end of the second pressure space, the outer cylinder rear head having a second facing surface for fluid pressure in the second pressure space to act to effect retraction of the outer cylinder; an intermediate cylinder front head carried on the forward end of the intermediate cylinder for slidably engaging the inner surface of the outer cylinder and sealing the forward end of the second pressure space, the intermediate cylinder front head cooperating with the inner cylinder head to form therebetween a third pressure space and having third facing surface for fluid pressure in the third pressure space to act to effect extension of the intermediate cylinder; an outer cylinder front head carried on the forward end of the outer cylinder for cooperating with the intermediate cylinder head to form therebetween a fourth pressure space, the outer cylinder front head having a fourth facing surface for fluid in the fourth pressure space to act to effect extension of the outer cylinder; a porting member at the rearward end of the inner cylinder including first, second, third and fourth inlet ports for selective connection to a source of pressure fluid; and first, second, third and fourth fluid delivery passages for delivering fluid under pressure from said first, second, third and fourth inlet ports forwardly through the interior of the inner cylinder and then to said first, second, third and fourth fluid pressure spaces, respectively.

Further in accordance with the invention, there is provided a multiple stage telescopic cylinder assembly comprising: a base at a rearward end of the assembly, the base including porting means comprising first, second, third and fourth inlet ports; an inner tubular structure attached at its rearward end to the base and first and second stage cylinders of successively greater diameter mounted on the inner tubular structure in telescoping relationship for extension during their forward strokes and retraction during their rearward strokes, the first and second stage cylinders each having extend facing means relatively adjacent its forward end for fluid pressure to contact to effect extension thereof and retract facing means relatively adjacent its rearward end for fluid pressure to contact to effect retraction thereof, the inner tubular structure circumscribing a generally cylindrical interior space; a pair of telescoping members extending axially through the interior space circumscribed by the inner tubular structure, one of the telescoping tubular members being attached to the base and the other of the telescoping tubular members being attached to the first stage cylinder for axial movement therewith; first fluid passage means for directing fluid under pressure from the first port forwardly through the inner tubular structure and then into contact with the extend facing means of the second stage cylinder; second fluid passage means for directing fluid under pressure from the second port forwardly through the inner tubular structure and then into contact with the retract facing means of the first stage cylinder; third fluid passage means for directing fluid under pressure from the third port forwardly through the inner tubular structure and then into contact with the extend facing means of the first stage cylinder; and fourth fluid passage means for directing fluid under pressure from the fourth port forwardly through the inner tubular structure and then into contact with the retract facing means of the second stage cylinder, the fourth fluid passage means including an axial passage is the other of the telescoping tubular members, and the pair of telescoping members forming with the inner tubular structure a fluid space connecting the axial passage to the fourth port.

According to another aspect of the invention, there is provided a multiple stage telescopic cylinder assembly comprising: a base at a rearward end of the assembly, the base including porting means comprising first, second, third and fourth inlet ports; an inner tubular structure attached at its rearward end to the base and first and second stage cylinders of successively greater diameter mounted on the inner tubular structure in telescoping relationship for extension during their forward strokes and retraction during their rearward strokes, the first and second stage cylinders each having extend facing means relatively adjacent its forward end for fluid pressure to contact to effect extension thereof and retract facing means relatively adjacent its rearward end for fluid pressure to contact to effect retraction thereof, the inner tubular structure circumscribing a generally cylindrical interior space; a pair of telescoping members extending axially through the interior space circumscribed by the inner tubular structure, one of the telescoping tubular members being attached to the base and the other of the telescoping tubular member being attached to the first stage cylinder for axial movement therewith; first fluid passage means for directing fluid under pressure from the first port forwardly through the inner tubular structure and then into contact with the extend facing means of the second stage cylinder; second fluid passage means for directing fluid under pressure from the second port forwardly through the inner tubular structure and then into contact with the retract facing means of the first stage cylinder; third fluid passage means for directing fluid under pressure from the third port forwardly through the inner tubular structure and then into contact with the retract facing means of the second stage cylinder; and fourth fluid passage means for directing fluid under pressure from the fourth port forwardly through the inner tubular structure and then into contact with the extend facing means of the first stage cylinder, the fourth fluid passage means including a passage extending axially through the inner tubular structure exteriorly of the interior space.

The foregoing and other features of the invention are hereinafter more fully described and particularly pointed out in the claims, the following description and the annexed drawings setting forth in detail a certain illustrative embodiment of the invention, this being indicative, however, of but one of the various ways in which the principles of the invention may be employed.

DETAILED DESCRIPTION

Figure 1:
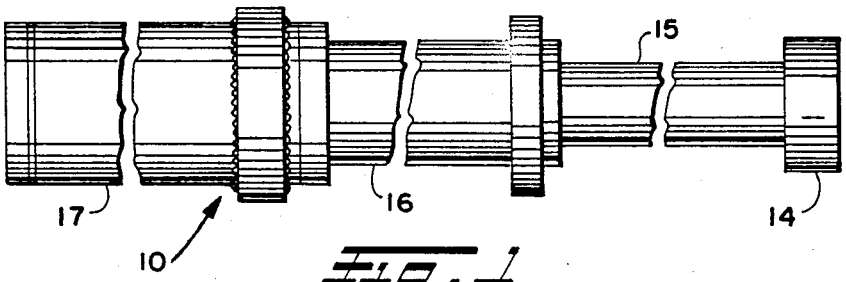
FIG. 1 is a broken side elevational view of a multiple stage telescopic cylinder assembly according to the present invention, the assembly being shown in a partly extended condition.

Referring now in detail to the drawings and initially to FIG. 1, a multiple stage telescopic cylinder assembly according to the invention is indicated generally at 10. The assembly 10 may be used as an actuator in boom cranes, digger derricks, pole setters and other extension/retraction mechanisms such as in place of the previously utilized telescoping cylinder assemblies. Accordingly, the assembly may be adapted externally for conventional attachment to the extension/retraction mechanism.

As shown, the telescopic cylinder assembly 10 generally comprises a base 14, an inner cylinder 15 attached at its rearward end to the base 14, and an intermediate cylinder 16 and an outer cylinder 17 of successively greater diameter mounted on the inner cylinder 15 in coaxial telescoping relationship for extension during their forward strokes away from the base and retraction during their rearward strokes toward the base. As seen at the right in FIG. 2B, the base 14 may be a generally block-like member having a bore 18 into which the rearward end portion of the inner cylinder 15 is threaded as shown.

Figure 2A:
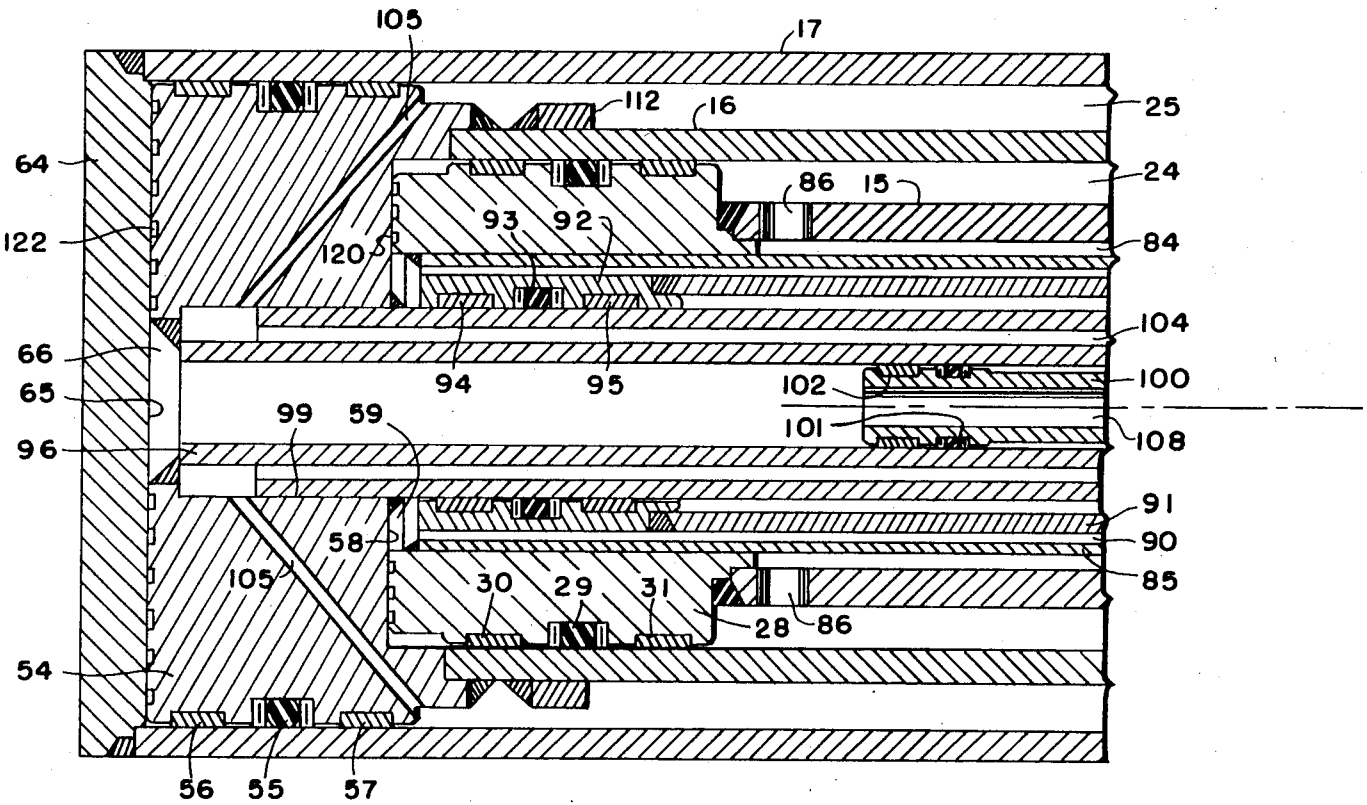
FIGS. 2A and 2B respectively are left hand and right hand fragments of an enlarged longitudinal cross-sectional view taken substantially along a diameter of the telescopic cylinder assembly in its fully retracted condition.
Figure 2B:
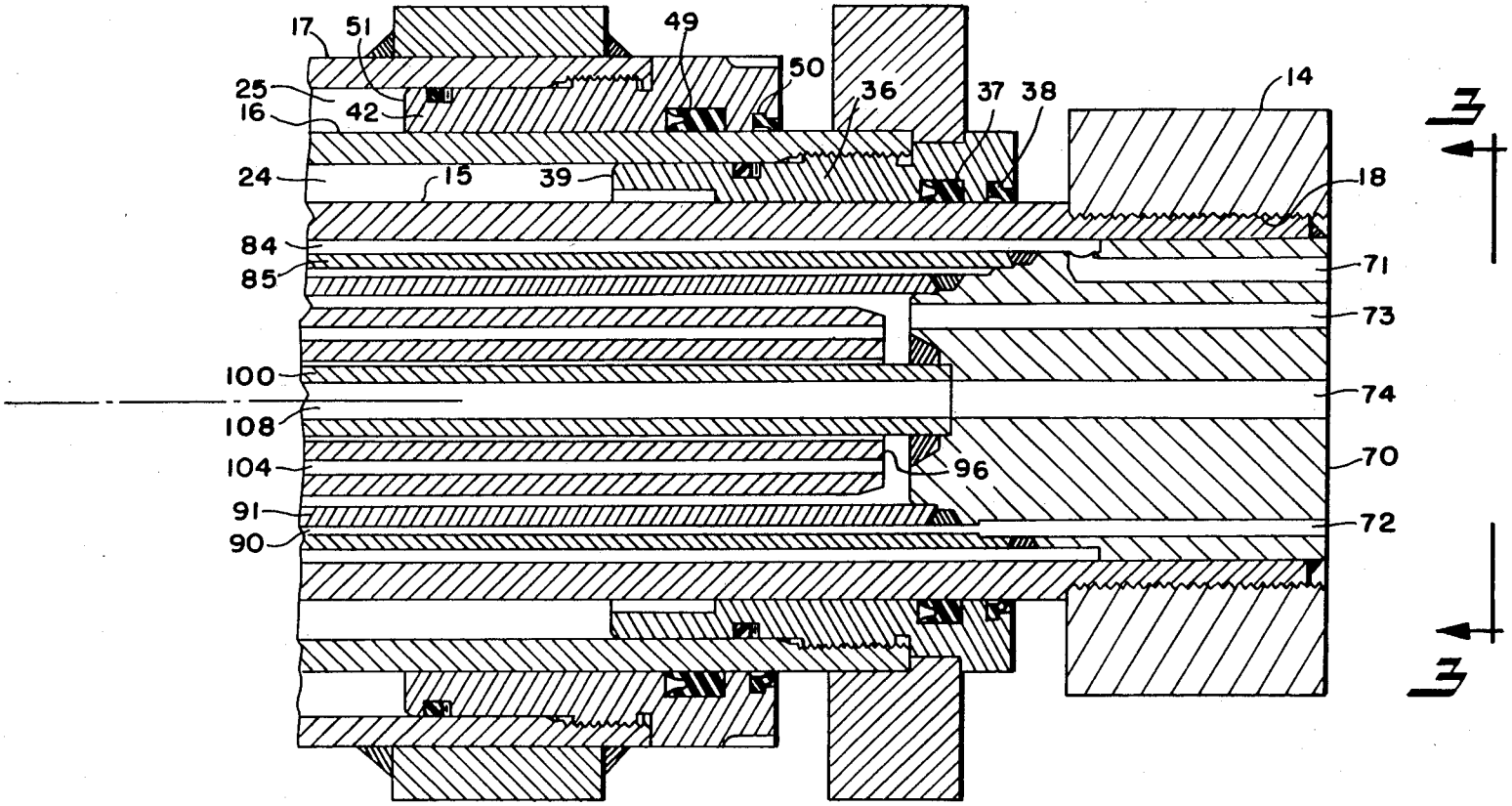

As seen in FIGS. 2A and 2B, the inner and intermediate cylinders 15 and 16 respectively have outer and inner diameter surfaces forming therebetween pressure space 24. Similarly, the intermediate and outer cylinders 16 and 17, herein also referred to as the first stage and second stage cylinders, respectively have outer and inner diameter surfaces forming therebetween pressure space 25. To facilitate an understanding of this description, pressure space 24 is herein referred to as a first stage retract (FSR) pressure space and pressure space 25 is herein referred to as a second stage retract (SSR) pressure space.

The inner cylinder 15, at its forward end, has attached thereto, as by welding, a front cylinder head 28. An annular seal 29 and slide rings 30 and 31 are mounted on the outer surface of the cylinder head 28 to provide a sliding seal between the cylinder head and the inner diameter surface of the first stage cylinder 16. Accordingly, the cylinder head 28 closes or seals the forward end of the FSR pressure space 24.

The intermediate or first stage cylinder 16, at its rearward end, has attached thereto, as by threaded securement, a rear cylinder head 36. An annular seal 37 and a wiper 38 are mounted on the inner surface of the cylinder head 36 to provide a sliding seal between the cylinder head 36 and the outer diameter surface of the inner cylinder 15. Accordingly, the rear cylinder head 36 closes or seals the rearward end of the FSR pressure space 24. The rear cylinder head 36 also has at its forward side an annular facing surface 39 against which fluid pressure in the FSR pressure space 24 acts to effect retraction of the first stage cylinder. The facing surface 39 is herein referred to as a first stage retract (FSR) facing surface.

Similarly, the outer or second stage cylinder 17, at its rearward end, has attached thereto, as by threaded securement, a rear cylinder head 42. Annular seal 49 and wiper 50 are mounted on the inner surface of the rear cylinder head 42 to provide a sliding seal between the rear cylinder head 42 and the outer diameter surface of the first stage cylinder 16. Accordingly, the rear cylinder head 42 closes or seals the rearward end of the SSR pressure space 25. The rear cylinder head 42 also has at its forward side an annular facing surface 51 against which fluid pressure in the SSR pressure space 25 acts to effect retraction of the second stage cylinder 17. The facing surface 51 is herein referred to as a second stage retract (SSR) facing surface.

As seen in FIG. 2A, the first stage cylinder 16, at its forward end, has attached thereto, as by welding, a front cylinder head 54. Annular seal 55 and side rings 56 and 57 are mounted on the outer surface of the front cylinder head 54 to provide a sliding seal between the front cylinder head 54 and the inner diameter surface of the second stage cylinder 17. Accordingly, the front cylinder head 54 closes or seals the forward end of the SSR pressure space 25. The front cylinder head 54 also has on its rearward side an annular facing surface 58 exposed to the interior of the first stage cylinder and against which fluid pressure in pressure space 59 acts to effect extension of the first stage cylinder. The facing surface 58 and pressure space 59 are herein respectively referred to as a first stage extend (FSE) facing surface and a first stage extend (FSE) pressure space.

At the forward end of the second stage cylinder 17 there is attached, as by welding, a front cylinder head 64. The front cylinder head 64 may be in the form of a circular plate which closes the forward end of the second stage cylinder. The front cylinder head 64 at its rearward side has a facing surface 65 exposed to the interior of the second stage cylinder and against which fluid pressure in pressure space 66 acts to effect extension of the second stage cylinder. The facing surface 65 and pressure space 66 are herein respectively referred to as a second stage extend (SSE) facing surface and a second stage extend (SSE) pressure space.

Figure 3:
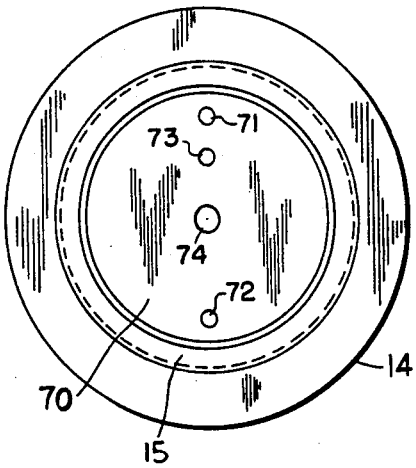
FIG. 3 is a reduced plan view taken substantially along the line 3—3 of FIG. 2B.

As seen at the right in FIG. 2B and in FIG. 3, the rearward end of the inner cylinder 15 is closed by a generally cylindrical porting member 70 which may be telescopically fitted in the inner cylinder and secured thereto as by welding. The porting member 70 is provided with four axially extending passages or ports 71–74. The ports 71–74 are herein referred to as a first stage retract, first stage extend, second stage retract and second stage extend ports, respectively.

Figure 4:
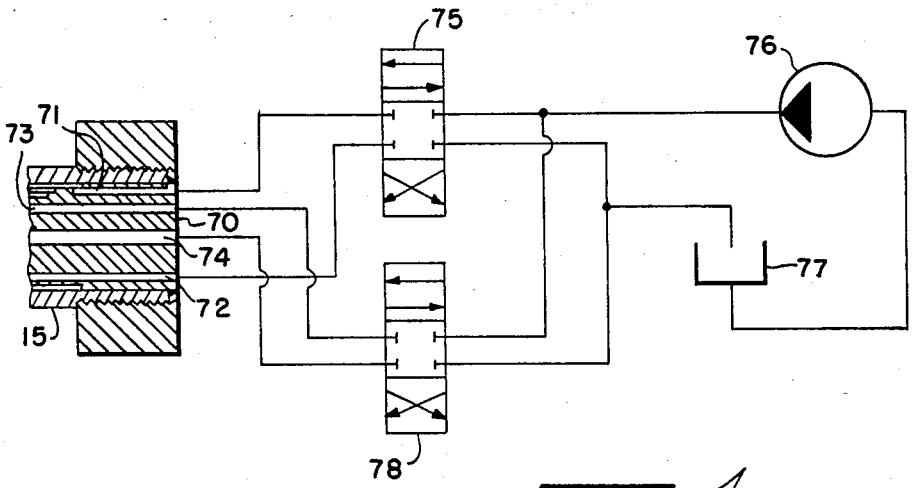
FIG. 4 is a schematic of hydraulic circuitry which may be used to actuate the telescopic cylinder assembly.

As schematically shown in FIG. 4, the FSR port 71 and FSE port 72 are connected to a three position first stage control valve 75 operative in a first position to block flow to and from such ports, in a second or FSE position to connect the FSE port 72 to a hydraulic pump 76 or other suitable source of pressure fluid and the FSR port 71 to a fluid return 77, and in a third or FSR position to reversely connect the FSE and FSR ports to the pump and return. Also, the SSR port 73 and SSE port 74 are connected to a three position second stage control valve 78 operative in a first position to block flow to and from such ports, in a second or SSE position to connect the SSE port 74 to the pump 76 and the SSR port to the return 77, and in a third or SSR position to reversely connect the SSE and SSR ports to the pump and return.

In the assembly 10, the first stage retract (FSR) port 71 is connected to an axially extending, annular passage 84 which is formed between the inner surface of the inner cylinder 15 and the outer surface of an outer internal cylinder 85. The outer internal cylinder 85 is concentric with and extends axially within the interior of the inner cylinder 15. The outer internal cylinder 85 is attached, as by welding, at its rearward end to the porting member 70 and at its forward end to the inner bore surface of the front cylinder head 28 of the inner cylinder 15. Rearwardly of the front cylinder head 28, the inner cylinder 15 has in the wall thereof one or more radial passages 86 which connect the passage 84 to the FSR pressure space 24.

The first stage extend (FSE) port 72 is connected to an axially extending, annular passage 90 which is formed between the inner surface of the outer internal cylinder 85 and the outer surface of an inner internal cylinder 91. The inner internal cylinder 91 is concentric with and extends axially within the outer internal cylinder. The inner internal cylinder 91 at its rearward end is attached as by welding to the porting member 70 and has attached to its forward end an annular sealing ring member 92. The outer surface of the sealing ring member 92 is radially inwardly spaced from the inner surface of the outer interior cylinder 85 to form a continuation of the passage 90 which connects to the FSE pressure space 59. At its inner surface, the sealing ring member 92 is provided with an annular seal 93 and slide rings 94 and 95 which provide a sliding seal between the sealing ring member 92 and the outer diameter surface of an outer telescoping tube 96.

As is apparent, the inner cylinder 15, outer internal cylinder 85 and inner internal cylinder 91 are all fixed with respect to one another and in one sense may be viewed as an inner tubular structure on which the first stage cylinder 16 is mounted for telescoping movement. This inner tubular structure also includes therein the axial passages 84 which connect the FSR port 71 to the FSR pressure space 24 and the passage 90 which connects FSE port 72 to FSE pressure space 59. This same structure also slidably engages and is sealed at 92 to the outer diameter surface of the outer telescoping tube 96, and further may be viewed as including the front cylinder head 28 of the inner cylinder 15.

The forward end of the outer telescoping tube 96 extends axially into a center through bore 99 of the front cylinder head 54 of the first stage cylinder 16 for welded attachment to the front cylinder head in the manner shown. The outer telescoping tube 96 is also supported on an inner tube 100 in coaxial telescoping relationship for relative extension during the forward stroke of the first stage cylinder and relative retraction during the rearward stroke of the first stage cylinder. At its forward end, the inner tube 100 has at its outer surface an annular seal 101 and slide ring 102 which provide a sliding seal between the forward end of the inner tube and the inner diameter surface of the outer telescoping tube 96. At its rearward end, the inner tube is attached as by welding to the porting member 70.

The cylindrical wall of the outer telescoping tube 96 has formed therein one or more axially extending passages 104 which connect the second stage extend (SSE) port 73 to a respective radial passage or passages 105 in the front cylinder head 54 of the first stage cylinder 16. The radial passage 105 slopes rearwardly through the front cylinder head 54 for connection to the SSR pressure space 25. As will be appreciated, the outer telescoping tube 96 may alternatively be replaced by two concentric tubes welded to the front cylinder head 54 and radially spaced apart to form therebetween the equivalent of the passage or passages 104.

The inner tube 100 also forms at the hollow interior thereof an axially extending passage 108 which is connected at its rearward end to the SSE port 74. At its forward end, the passage 108 opens to the forward end of the inner tube 100 and the forward extension of the outer telescoping cylinder 96 forms at the hollow interior thereof a continuation of the passage 108 which connects to the SSE pressure space 66.

OPERATION

Stage selection of the above described telescoping cylinder assembly 10 is accomplished in the following manner. To extend the first stage cylinder 16, as from its fully retracted position shown in FIGS. 2A and 2B, first stage control valve 75 is moved to its FSE position to connect the FSE port 72 to the hydraulic pump and the FSR port 71 to the fluid return 77. From the FSE port 72 pressurized fluid is directed by the passage 90 to the FSE pressure space 59 where it will act upon the FSE facing surface 58 of the front cylinder head 54 of the first stage cylinder 16 and exert sufficient force to move forwardly the first stage cylinder. The first stage cylinder will extend until its rear cylinder head 36 abuts the front cylinder head 28 of the inner cylinder 15. As the first stage cylinder is thusly being extended, fluid in the FSR pressure space 24 will be returned via passages 86 and 84 and FSR port 71 to the fluid return. The front cylinder head 28 of the inner cylinder 15 may be provided with spiral grooves 120 in its front end surface to facilitate pressure fluid access behind the front cylinder head 54 of the first stage cylinder.

To retract the first stage cylinder 16 from an extended position, the first stage control valve 75 is moved to its FSR position to connect the FSR port 71 to the hydraulic pump 76 and the FSE port 72 to the fluid return 77. From the FSR port 71, pressurized fluid will be directly by the axial passage 84 and the radial passage 86 to the FSR pressure space 24 where the fluid will act upon the FSR facing surface 39 of the rear cylinder head 36 of the first stage cylinder 16 and exert sufficient force to move rearwardly the first stage cylinder. As the first stage cylinder is thusly being retracted, fluid in the FSE pressure space 59 will be returned via passage 90 and FSE port 72 to the fluid return.

Independently of the first stage cylinder 16, the second stage cylinder 17 may be extended relative to the first stage cylinder 16 by moving the second stage control valve 78 to its SSE position to connect the SSE port 74 to the hydraulic pump 76 and the SSR port 73 to the fluid return 77. From the SSE port 74, pressurized fluid will flow through the passage 108 to the SSE pressure space 66. The pressurized fluid delivered to the SSE pressure space 66 will act upon the SSE facing surface 65 of the front cylinder head 64 of the second stage cylinder to extend the second stage cylinder with respect to the first stage cylinder. The second stage cylinder will extend until its rear cylinder head 42 abuts a stroke limiting stop flange 112 secured to the outside surface of the first stage cylinder 16. As the second stage cylinder is thusly being extended, fluid in the SSR pressure space 25 will be directed by radial passage 105, axial passage 104 and SSR port 73 to the fluid return 77. The front cylinder head 54 of the first stage cylinder 16 may be provided with spiral grooves 122 in its front end surface to facilitate pressure fluid access behind the front cylinder head 64 of the second stage cylinder.

To retract the second stage cylinder 17, the second stage control valve 78 is moved to its SSR position to connect the SSR port 73 to the hydraulic pump 76 and the SSE port 72 to the fluid return 77. From the SSR port 73, pressurized fluid will flow through the axial passage 104 and radial passage 105 to the SSR pressure space 25. The pressurized fluid delivered to the SSR pressure space 25 will then act on the FSR facing surface 51 of the rear cylinder head 42 of the second stage cylinder to effect retraction of the second stage cylinder. As the second stage cylinder is thusly being retracted, fluid in the SSE pressure space 66 will be directed through the passage 108 and SSE port 74 to the fluid return.

As will be appreciated, the first and second stage control valves 75 and 78 may be selectively operated to effect extension or retraction of the first and second stage cylinders 16 and 17 independently of one another. For example, the first stage cylinder 16 may be extended with respect to the inner cylinder 15 while the second stage cylinder 17 remains stationary with respect to the first stage cylinder. The first and second stage cylinders may also be simultaneously extended (or retracted) by moving both control valves to their extend (or retract) positions at the same time. Also, assuming that the first stage cylinder has been extended but not the second stage cylinder relative to the first stage cylinder, the first stage cylinder may be retracted while the second stage cylinder is extended through selective operation of the control valves. In summary, the above described assembly achieves full stage selection capability with all fluid porting being accomplished interiorly of the assembly.

Although the invention has been shown and described with respect to a preferred embodiment, equivalent alterations and modifications will in all likelihood occur to others skilled in the art upon the reading and understanding of this specification. The present invention includes all such equivalent alterations and modifications, and is limited only the scope of the following claims.

What is claimed is:

1. A multiple stage telescopic cylinder assembly comprising:

a base at a rearward end of the assembly, said base including porting means comprising first, second, third and fourth inlet ports;

an inner tubular structure attached at its rearward end to said base and first and second stage cylinders of successively greater diameter mounted on said inner tubular structure in telescoping relationship for extension during their forward strokes and retraction during their rearward strokes, said first and second stage cylinders each having extend facing means relatively adjacent its forward end for fluid pressure to contact to effect extension thereof and retract facing means relatively adjacent its rearward end for fluid pressure to contact to effect retraction thereof, said inner tubular structure circumscribing a generally cylindrical interior space;

a pair of telescoping members extending axially through said interior space circumscribed by said inner tubular structure, one of said telescoping tubular members being attached to said base and the other of said telescoping tubular members being attached to said first stage cylinder for axial movement therewith;

first fluid passage means for directing fluid under pressure from said first port forwardly through said inner tubular structure and then into contact with the extend facing means of said second stage cylinder;

second fluid passage means for directing fluid under pressure from said second port forwardly through said inner tubular structure and then into contact with the retract facing means of said first stage cylinder;

third fluid passage means for directing fluid under pressure from said third port forwardly through said inner tubular structure and then into contact with the extend facing means for said first stage cylinder; and fourth fluid passage means for directing fluid under pressure from said fourth port forwardly through said inner tubular structure and then into contact with the retract facing means of said second stage cylinder, said fourth fluid passage means including an axial passage is said other of said telescoping tubular members, and said pair of telescoping members forming with said inner tubular structure a fluid space connecting said axial passage to said fourth port.

2. An assembly as set forth in claim 1, wherein said first fluid passage means includes an axial passage formed interiorly of said pair of telescoping tubular members.

3. An assembly as set forth in claim 2, wherein said second fluid passage means includes a passage extending axially through said inner tubular structure exteriorly of said interior space.

4. An assembly as set forth in claim 3, wherein said third fluid passage means includes a passage extending axially through said inner tubular structure exteriorly of said interior space.

5. An assembly as set forth in claim 4, wherein said inner tubular structure includes a support cylinder on which said first stage cylinder is mounted for telescoping movement, an inner cylinder member circumscribing said telescoping tubes within the interior of said support cylinder, and an outer cylinder member circumscribing said inner cylinder member within the interior of said support cylinder, said passage of said third fluid passage means being formed between said inner cylinder member and said outer cylinder member.

6. An assembly as set forth in claim 5, wherein said passage of said second fluid passage means is formed between said outer cylinder member and said support member.

7. An assembly as set forth in claim 3, wherein said inner tubular structure includes a support cylinder on which said first stage cylinder is mounted for telescoping movement, an inner cylinder member circumscribing said telescoping tubes within the interior of said support cylinder, and an outer cylinder member circumscribing said inner cylinder member within the interior of said support cylinder, said passage of said second fluid passage means being formed between said outer cylinder member and said support member.

8. An assembly as set forth in claim 1, wherein said inner tubular structure and said first stage cylinder respectively have outer and inner surfaces forming therebetween a first pressure space, said first stage cylinder and said second stage cylinder respectively have outer and inner surfaces forming a second pressure space, said inner tubular structure has at the forward end thereof inner cylinder head means for slidably engaging the inner diameter surface of said first stage cylinder and for sealing the forward end of said first pressure space, said first stage cylinder has at the rearward end thereof intermediate cylinder rear head means for slidably engaging the outer diameter surface of said inner tubular structure and for sealing the rearward end of said first pressure space, said intermediate cylinder rear head means includes said retract facing means of said first stage cylinder, said outer cylinder has at the rearward end thereof outer cylinder rear head means for slidably engaging the outer surface of said first stage cylinder and for sealing the rearward end of said second pressure space, said outer cylinder rear head means includes said retract facing means of said second stage cylinder, said first stage cylinder has at the forward end thereof intermediate cylinder front head means for slidably engaging the inner surface of said second stage cylinder and for sealing the forward end of said second pressure space, said intermediate cylinder front head means cooperates with said inner cylinder head means to form therebetween a third pressure space and includes said extend facing means of said first stage cylinder, said second stage cylinder has at the forward end thereof outer cylinder head means cooperating with said intermediate cylinder head means to form therebetween a fourth pressure space, said outer cylinder front head means includes said extend facing means of said second stage cylinder, and said second, fourth, third and first fluid passage means are respectively connected to said first, second, third and fourth pressure spaces.

9. A multiple stage telescopic cylinder assembly comprising:

a base at a rearward end of the assembly, said base including porting means comprising first, second, third and fourth inlet ports;

an inner tubular structure attached at its rearward end to said base and first and second stage cylinders of successively greater diameter mounted on said inner tubular structure in telescoping relationship for extension during their forward strokes and retraction during their rearward strokes, said first and second stage cylinders each having extend facing means relatively adjacent its forward end for fluid pressure to contact to effect extension thereof and retract facing means relatively adjacent its rearward end for fluid pressure to contact to effect retraction thereof, said inner tubular structure circumscribing a generally cylindrical interior space;

a pair of telescoping members extending axially through said interior space circumscribed by said inner tubular structure, one of said telescoping tubular members being attached to said base and the other of said telescoping tubular members being attached to said first stage cylinder for axial movement therewith;

first fluid passage means for directing fluid under pressure from said first port forwardly through said inner tubular structure and then into contact with the retract facing means of said first stage cylinder;

second fluid passage means for directing fluid under pressure from said second port forwardly through said inner tubular structure and then into contact with the retract facing means of said first stage cylinder;

third fluid passage means for directing fluid under pressure from said third port forwardly through said inner tubular structure and then into contact with the retract facing means of said second stage cylinder; and fourth fluid passage means for directing fluid under pressure from said fourth port forwardly through inner tubular structure and then into contact with the extend facing means of said first stage cylinder, said fourth fluid passage means including a passage extending axially through said inner tubular structure exteriorly of said interior space.

10. An assembly as set forth in claim 7, wherein said first fluid passage means includes an axial passage formed interiorly of said pair of telescoping tubular members.

11. An assembly as set forth in claim 10, wherein said second fluid passage means includes a passage extending axially through said inner tubular structure exteriorly of said interior space.

12. An assembly as set forth in claim 11, wherein said inner tubular structure includes a support cylinder on which said first stage cylinder is mounted for telescoping movement, an inner cylinder member circumscribing said telescoping tubes within the interior of said support cylinder, and an outer cylinder member circumscribing said inner cylinder member within the interior of said support cylinder, said passage of said fourth fluid passage means being formed between said inner cylinder member and said outer cylinder member.

13. An assembly as set forth in claim 12, wherein said passage of said second fluid passage means is formed between said outer cylinder member and said support member.

14. An assembly as set forth in claim 11, wherein said inner tubular structure includes a support cylinder on which said first stage cylinder is mounted for telescoping movement, an inner cylinder member circumscribing said telescoping tubes within the interior of said support cylinder, and an outer cylinder member circumscribing said inner cylinder member within the interior of said support cylinder, said passage of said second fluid passage means being formed between said outer cylinder member and said support member.

15. An assembly as set forth in claim 9, wherein said inner tubular structure includes a support cylinder on which said first stage cylinder is mounted for telescoping movement, an inner cylinder member circumscribing said telescoping tubes within the interior of said support cylinder, and an outer cylinder member circumscribing said inner cylinder member within the interior of said support cylinder, said passage of said fourth fluid passage means being formed between said inner cylinder member and said outer cylinder member.

16. An assembly as set forth in claim 9, wherein said inner tubular structure and said first stage cylinder respectively have outer and inner surfaces forming therebetween a first pressure space, said first stage cylinder and said second stage cylinder respectively have outer and inner surfaces forming a second pressure space, said inner tubular structure has at the forward end thereof inner cylinder head means for slidably engaging the inner diameter surface of said first stage cylinder and for sealing the forward end of said first pressure space, said first stage cylinder has at the rearward end thereof intermediate cylinder rear head means for slidably engaging the outer diameter surface of said inner tubular structure and for sealing the rearward end of said first pressure space, said intermediate cylinder rear head means includes said retract facing means of said first stage cylinder, said outer cylinder has at the rearward end thereof outer cylinder rear head means for slidably engaging the outer surface of said first stage cylinder and for sealing the rearward end of said second pressure space, said outer cylinder rear head means includes said retract facing means of said second stage cylinder, said first stage cylinder has at the forward end thereof intermediate cylinder front head means for slidably engaging the inner surface of said second stage cylinder and for sealing the forward end of said second pressure space, said intermediate cylinder front head means cooperates with said inner cylinder head means to form therebetween a third pressure space and includes said extend facing means of said first stage cylinder, said second stage cylinder has at the forward end thereof outer cylinder front head means cooperating with said intermediate cylinder head means to form therebetween a fourth pressure space, said outer cylinder front head means includes said extend facing means of said second stage cylinder, and said second, third, fourth and first fluid passage means are respectively connected to said first, second, third and fourth pressure spaces.

* * * * *